US009349499B2

(12) United States Patent
Kikuchi et al.

(10) Patent No.: US 9,349,499 B2
(45) Date of Patent: May 24, 2016

(54) INSULATED WIRE, AND COIL AND MOTOR FORMED USING THE INSULATED WIRE

(71) Applicant: Hitachi Metals, Ltd., Tokyo (JP)

(72) Inventors: Hideyuki Kikuchi, Hitachi (JP); Hidehito Hanawa, Hitachi (JP); Masashi Arai, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 126 days.

(21) Appl. No.: 14/221,214

(22) Filed: Mar. 20, 2014

(65) Prior Publication Data

US 2014/0299350 A1 Oct. 9, 2014

(30) Foreign Application Priority Data

Apr. 8, 2013 (JP) ..... 2013-080845

(51) Int. Cl.

| | |
|---|---|
| ***H01B 3/30*** | (2006.01) |
| ***H01B 3/44*** | (2006.01) |
| ***H01B 7/00*** | (2006.01) |
| ***H01B 7/295*** | (2006.01) |
| ***H01B 11/02*** | (2006.01) |

(52) U.S. Cl.

CPC ..... *H01B 3/308* (2013.01); *H01B 3/303* (2013.01)

(58) Field of Classification Search

None

See application file for complete search history.

(56) References Cited

U.S. PATENT DOCUMENTS

| | | | | |
|---|---|---|---|---|
| 4,275,319 | A * | 6/1981 | Davis, Jr. | C08F 279/02 428/519 |
| 4,410,405 | A * | 10/1983 | Bergna | C01B 33/141 516/83 |
| 5,711,165 | A * | 1/1998 | Iizuka | F25B 31/002 252/68 |
| 2004/0020679 | A1* | 2/2004 | Kadotani | E04C 5/10 174/70 C |
| 2006/0068201 | A1* | 3/2006 | Alexander | C08K 3/34 428/357 |
| 2006/0240254 | A1* | 10/2006 | Kikuchi | C08K 5/3415 428/375 |
| 2009/0032295 | A1* | 2/2009 | Okajima | H05K 1/0203 174/260 |
| 2010/0072126 | A1* | 3/2010 | Tsujimoto | B01D 39/1623 210/491 |
| 2011/0290528 | A1* | 12/2011 | Honda | C08G 73/14 174/119 C |
| 2011/0294954 | A1* | 12/2011 | Fukutani | C08F 2/22 525/118 |

FOREIGN PATENT DOCUMENTS

| | | |
|---|---|---|
| JP | 08-029257 A | 2/1996 |
| JP | 2006-252852 A | 9/2006 |

OTHER PUBLICATIONS

Japanese Office Action dated Jan. 26, 2016 with an English translation.

* cited by examiner

*Primary Examiner* — Chau N Nguyen
*Assistant Examiner* — Roshn Varghese
(74) *Attorney, Agent, or Firm* — McGinn IP Law Group PLLC

(57) ABSTRACT

An insulated wire used under a condition where the insulated wire is brought into contact with ester-based synthetic oil includes a conductor and an insulating film on a periphery of the conductor. The insulating film is composed of an insulating paint including at least one resin component selected from polyamide imide, polyester imide, and polyimide and inorganic fine particles including alkali metal ion or alkaline-earth metal ion.

20 Claims, 3 Drawing Sheets

INSULATED WIRE, AND COIL AND MOTOR FORMED USING THE INSULATED WIRE

The present application is based on Japanese patent application No. 2013-080845 filed on Apr. 8, 2013, the entire contents of which are incorporated herein by reference.

BACKGROUND OF THE INVENTION

1. Field of the Invention

The present invention relates to an insulated wire and to a coil and a motor that are formed using the insulated wire.

2. Description of the Related Art

Motors are used in drive units of compressors for refrigeration machines and compression machines, vehicles, and the like. A drive unit of compressors, vehicles, and the like includes a container having a high sealing property and incorporates a motor housed in the container. The container may include an air breather in order to compensate for variations in internal pressure due to temperature rise. Thus, the motor is hermetically or substantially hermetically sealed in the container of the drive unit.

The motor used in the drive unit includes a coil. The coil is formed by winding an enamelled wire (insulated wire). The insulated wire includes a conductor and an insulating film composed of an insulating paint on the periphery of the conductor. The insulating film is required to have an insulating property or the like and is composed of polyester, polyester imide, polyimide, or the like.

Such a drive unit requires strict moisture control in the container that houses the motor. Even a trace amount of moisture present in the container reduces the insulating property of the motor with the operation time of the motor, which results in poor insulation. Specifically, operation of the drive unit increases the temperature inside the container, and accordingly the internal pressure of the container increases. Therefore, if moisture is present in the container, the reactivity of the moisture is increased, and the moisture causes hydrolysis of the insulating film of the insulated wire that constitutes the coil of the motor and thereby degrades the insulating film. The insulating film gradually becomes degraded with the operation time of the drive unit, which reduces the insulating property of the motor. As a result, dielectric breakdown occurs. Even when the container includes an air breather in order to control the internal pressure of the container, moisture is likely to enter the container through the air breather. This promotes hydrolysis of the insulating film due to the temperature rise in the container, and thereby dielectric breakdown occurs.

In this respect, in order to reduce the amount of moisture entering a container including an air breather, a method in which a moisture absorbent is installed in the air breather has been proposed (e.g., Japanese Unexamined Patent Application Publication No. 8-29257).

SUMMARY OF THE INVENTION

The container of the drive unit also houses lubricating oil used for cooling the motor. The motor is cooled in the container of the drive unit by being entirely or partially immersed in the lubricating oil or by being placed in an atmosphere in which the lubricating oil is in the form of mist.

The inside of the drive unit becomes a high-temperature, high-pressure environment during operation. Therefore, the lubricating oil housed in the container is required to have lubricity, thermal stability, and the like as well as cooling capability. Examples of the lubricating oil include mineral oil and synthetic oil. Recently, synthetic oil has been used as lubricating oil because synthetic oil has better properties than mineral oil. Examples of the synthetic oil include ester-based synthetic oil and partial synthetic oil that is partially composed of ester-based synthetic oil.

When the motor is housed in the container with ester-based synthetic oil, the insulating property of the motor is more likely to be disadvantageously reduced compared with the case where the motor is housed in the container with mineral oil. In other words, when the insulated wire constituting the coil of the motor is brought into contact with ester-based synthetic oil, hydrolysis of the insulating film proceeds more rapidly, which degrades the insulated wire earlier. Thus, a drive unit that houses a motor with ester-based synthetic oil tends to have a short operating life.

In order to address this issue, the amount of moisture entering the container that houses the motor may be further reduced. However, the insulating film of the insulated wire used in the motor contains moisture absorbed from the atmosphere, and the moisture absorbed in the insulating film disadvantageously enters the container when the motor is housed into the container of the drive unit. Thus, the amount of moisture entering the container can only be reduced to a certain degree, and it is difficult to suppress the degradation of the insulating film caused by hydrolysis.

Accordingly, it is an object of the present invention to provide an insulated wire with which the degradation of the insulating film is suppressed when the insulated wire is used under a condition where the insulated wire is brought into contact with ester-based synthetic oil and to provide a coil and a motor that are formed using the insulated wire.

According to a first aspect of the present invention, there is provided an insulated wire used under a condition where the insulated wire is brought into contact with ester-based synthetic oil, the insulated wire including:

a conductor; and an insulating film on a periphery of the conductor, the insulating film being composed of an insulating paint including:

at least one resin component selected from polyamide imide, polyester imide, and polyimide; and inorganic fine particles including alkali metal ion or alkaline-earth metal ion.

According to a second aspect of the present invention, the insulating film includes 0.003 parts by mass or more and 0.018 parts by mass or less of the alkali metal ion or alkaline-earth metal ion relative to 100 parts by mass of the at least one resin component.

According to a third aspect of the present invention, the insulating film includes 1 part by mass or more and 30 parts by mass or less of the inorganic fine particles relative to 100 parts by mass of the at least one resin component.

According to a fourth aspect of the present invention, a retention of a dielectric breakdown voltage of the insulated wire is 60% or more after the insulated wire is immersed in the ester-based synthetic oil for 2,000 hours.

According to a fifth aspect of the present invention, there is provided a coil formed by winding the insulated wire described above.

According to a sixth aspect of the present invention, there is provided a motor including the coil described above.

According to the present invention, there is provided an insulated wire with which the degradation of an insulating film is suppressed when used in an condition where the insulated wire is brought into contact with ester-based synthetic oil. There are also provided a coil and a motor that are formed using the insulated wire.

DESCRIPTION OF THE PREFERRED EMBODIMENTS

Figure 1:
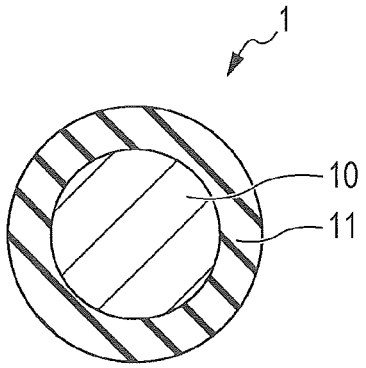
FIG. 1 is a cross-sectional view of an insulated wire according to an embodiment of the present invention.

Referring now to the drawings, and more particularly to FIGS. 1-7, there are shown exemplary embodiments of the methods and structures according to the present invention.

Findings Made by Inventors

The findings made by the inventors of the present invention are described prior to the description of an embodiment of the present invention.

As described above, in a drive unit, a motor is housed in a container with lubricating oil, and moisture entering the container causes hydrolysis of an insulating film of an insulated wire of the motor and thereby degrades the insulating film. In particular, when ester-based synthetic oil is used as lubricating oil, the insulating film becomes degraded earlier and consequently the drive unit has a shorter operating life compared with the case where mineral oil is used.

The inventors of the present invention have conducted extensive studies to determine why hydrolysis of the insulating film is likely to be promoted, which results in the insulating film becoming degraded earlier, when the insulated wire is used under a condition where the insulated wire is brought into contact with ester-based synthetic oil, that is, for example, when the insulated wire is used as a coil of a motor immersed in ester-based synthetic oil. As a result, the inventors have found that the main reason for the degradation of the insulating film is not the hydrolysis itself but an acid component produced by the hydrolysis of the ester-based synthetic oil caused by moisture.

The above-described points are described below in detail.

Ester-based synthetic oil is produced from an acid component and an alcohol component. Moisture entering the container causes hydrolysis of ester-based synthetic oil to yield an acid component. Production of the acid component consumes moisture, and therefore direct degradation of the insulating film caused by moisture is reduced. However, in a container having a high temperature (e.g., about 150° C.) due to operation of a drive unit, the produced acid component has a higher reactivity than moisture and causes the insulating film to be degraded more. Specifically, when the insulating film is composed of polyester, polyester imide, or the like, the acid component enters the insulating film and causes the insulating film to be degraded by breaking the ester linkage of polyester or the like. When the insulating film is composed of polyamide imide or the like, the acid component causes the insulating film to be degraded by breaking the imide linkage or the like. A coil of a motor includes varnish such as unsaturated polyester or acid-anhydride curable epoxy and is thus caused to be degraded by the acid component as well as the insulating film. The coil of a motor also includes a phase-to-phase insulating paper such as a polyester film (e.g., PET or PEN) and is thus caused to be degraded by the acid component as well as the insulating film.

The type of acid component produced differs depending on the ester-based synthetic oil. Examples of ester-based synthetic oil include an organic acid ester, a phosphoric acid ester, and a silicic acid ester, which respectively yield an organic acid, a phosphoric acid, and a silicic acid as an acid component. Among these acid components, the organic acid tends to have a high reactivity that causes the insulating film to be degraded. Examples of the organic acid include a monocarboxylic acid and a dibasic dicarboxylic acid (hereafter, also referred to as dibasic acid). Among these organic acids, a dibasic acid, particularly a dibasic acid having a small carbon number, has a higher reactivity and promotes the degradation of the insulating film more. Examples of such a dibasic acid include adipic acid, sebacic acid, and phthalic acid.

Hydrolysis of ester-based synthetic oil caused by moisture yields an alcohol component in addition to an acid component. The type of alcohol component produced differs depending on the ester-based synthetic oil. Examples of the alcohol component include ethylene glycol, neopentyl glycol, and pentaerythritol. An alcohol component has a lower reactivity than an acid component such as a dibasic acid and therefore has a small effect on the degradation of the resin component.

On the basis of the above-described facts, the inventors of the present invention considered that an insulated wire used under a condition where the insulated wire is brought into contact with ester-based synthetic oil needs to have improved resistance to the acid component produced from the ester-based synthetic oil. Thus, the inventors have conducted extensive studies on a method for improving the insulating film in terms of the resistance to an acid component. As a result, the inventors have found that the degradation of the insulating film may be suppressed even under the condition where the insulated wire is brought into contact with ester-based synthetic oil by dispersing inorganic fine particles containing alkali metal ions or alkaline-earth metal ions in the insulating film. Specifically, the alkali metal ions or alkaline-earth metal ions capture the acid component produced from ester-based synthetic oil and thereby suppresses the disadvantageous effect of the acid component which causes the insulating film to be degraded.

The present invention was made on the basis of the above-described findings.

An Embodiment of the Present Invention

Hereafter, an embodiment of the present invention is described with reference to FIG. 1. FIG. 1 is a cross-sectional view of an insulated wire according to an embodiment of the present invention.

(1) Insulated Wire

An insulated wire 1 according to an embodiment of the present invention is used for preparing, for example, a coil used under a condition where the coil is brought into contact with ester-based synthetic oil. The insulated wire 1 according to the embodiment includes a conductor 10 and an insulating film 11 on the periphery of the conductor 10. The insulating film 11 is composed of an insulating paint including at least one resin component selected from polyamide imide, polyester imide, and polyimide and inorganic fine particles containing alkali metal ions or alkaline-earth metal ions in order to, as described above, suppress the degradation of the insulating film 11 caused by the acid component produced from the ester-based synthetic oil. In other words, the insulated wire 1 according to the embodiment is used under a condition where the insulated wire 1 is brought into contact with ester-based synthetic oil and includes the conductor 10 and the insulating film 11 on the periphery of the conductor 10, and the inorganic fine particles containing alkali metal ions or alkaline-earth metal ions are dispersed in the insulating film 11.

Examples of the conductor 10 include a copper wire composed of low-oxygen copper or oxygen-free copper, a copper alloy wire, and a metal wire composed of aluminium, silver, nickel, or the like. FIG. 1 shows a conductor 10 having a circular cross section, but the conductor 10 is not limited to this. For example, the conductor 10 may have a rectangular cross section. The conductor 10 may be a stranded wire prepared by twisting a plurality of wires together. The diameter of the conductor 10 is not particularly limited and is appropriately set to an optimal value depending on the application.

The insulating film 11 is formed by applying a predetermined insulating paint to the periphery of the conductor 10 and baking the resulting conductor 10.

The insulating paint includes at least one resin component selected from polyamide imide, polyester imide, and polyimide and inorganic fine particles containing alkali metal ions or alkaline-earth metal ions. Specifically, the insulating paint includes a resin component (plastic paint) prepared by dissolving polyamide imide or the like in a solvent and inorganic fine particles containing predetermined ions which are dispersed in the resin component. The insulating paint is cured by being heated by baking to form the insulating film 11. Thus, the insulating film 11 composed of the insulating paint is composed of at least one resin component selected from polyamide imide, polyester imide, and polyimide and includes the inorganic fine particles dispersed therein.

The inorganic fine particles contain alkali metal ions such as sodium ions (Na ions) or potassium ions (K ions) or alkaline-earth metal ions such as magnesium ions (Mg ions) or calcium ions (Ca ions). The expression "inorganic fine particles contain alkali metal ions" herein means that the alkali metal ions are present inside the inorganic fine particles. The alkali metal ions and alkaline-earth metal ions are considered to have conductivity, but the conductivity of these ions is reduced when they are present inside the inorganic fine particles, which suppresses a reduction in the insulating property of the insulating film 11.

The alkali metal ions and alkaline-earth metal ions react with an acid component (e.g., dibasic acid) that is produced from ester-based synthetic oil and that causes the insulating film 11 to be degraded and thereby form a salt. When the salt is formed, the acid component loses its reactivity that causes the insulating film 11 to be degraded by breaking the linkage of the resin component of the insulating film 11. In other words, formation of the salt suppresses the degradation of the insulating film 11 caused by the acid component. Thus, the alkali metal ions and alkaline-earth metal ions react with the acid component to form a salt, thereby capture and inactivate the acid component, and suppress the degradation of the insulating film 11.

In the insulated wire 1 according to the embodiment, the insulating film 11 is composed of at least one resin component selected from polyamide imide, polyester imide, and polyimide and has a high insulating property and mechanical property. However, these resins have an ester linkage or an imide linkage in their molecules and therefore are likely to be degraded by an acid component produced from ester-based synthetic oil. In this regard, the insulating film 11 according to the embodiment includes inorganic fine particles containing alkali metal ions or alkaline-earth metal ions which are dispersed in the insulating film 11. As described above, the alkali metal ions and alkaline-earth metal ions react with an acid component to form a salt, thereby inactivate the acid component, and suppress the degradation of the insulating film 11 caused by the acid component. Specifically, in the insulated wire 1, the degradation of the insulating film 11 caused by an acid component is suppressed, and the retention of dielectric breakdown voltage after the insulated wire 1 is immersed in ester-based synthetic oil for a predetermined time (see Examples below) preferably reaches 60% or more after 1,000 hour immersion and more preferably 70% or more after 2,000 hour immersion. Since the degradation of the insulating film 11 caused by an acid component is suppressed, occurrence of cracking in the insulating film 11 is suppressed even when the insulated wire 1 is immersed in ester-based synthetic oil for a prolonged time.

The type of inorganic fine particles is not particularly limited as long as they contain the alkali metal ions or alkaline-earth metal ions. Examples of the inorganic fine particles include inorganic particles such as bentonite clay minerals including montmorillonite, smectite, and mica, silica, alumina, zirconia, titania, yttria, and calcium carbonate. These inorganic fine particles may be inorganic fine particles artificially synthesized and preferably produced from a mineral substance. Mineral substances originally contain alkali metal ions or alkaline-earth metal ions. Inorganic fine particles produced from a mineral substance include alkali metal ions or alkaline-earth metal ions that are derived from the mineral substance. Therefore, when inorganic fine particles are produced from a mineral substance, the content of the alkali metal ions or the like can be changed appropriately by changing manufacturing conditions.

Inorganic fine particles may be directly added and dispersed in an insulating paint and preferably added in the form of an organosol formed by dispersing the inorganic fine particles in an organic solvent in order to improve the dispersibility of the inorganic fine particles in the insulating paint. Adding the organosol in the insulating paint improves the dispersibility of the inorganic fine particles in the insulating paint, that is, the dispersibility of the inorganic fine particles in the insulating film 11 composed of the insulating paint. This suppresses occurrence of insulation failure of the insulating film 11 and improves mechanical properties of the insulating film 11, such as flexibility and toughness.

The type of organosol including the inorganic fine particles is not particularly limited, but preferably a silica sol, more preferably a silica sol produced from sodium silicate that is a mineral substance, which is produced by, for example, cation-exchange of sodium silicate and heating of the resulting compound in the presence of an alkaline catalyst. This silica sol contains a certain amount of alkali metal ions, that is, Na ions, and further suppresses the degradation of the insulating film 11.

Since the alkali metal ions and alkaline-earth metal ions contained in the inorganic fine particles are considered to have conductivity, the contents of these metal ions are preferably small in order to maintain the insulating property of the insulating film 11 and to suppress the degradation of the insulating film 11. Specifically, the insulating film 11 preferably includes 0.003 parts by mass or more and 0.018 parts by mass or less of alkali metal ions or alkaline-earth metal ions relative to 100 parts by mass of the resin component constituting the insulating film 11. This maintains the high insulating property of the insulating film 11 and suppresses the degradation of the insulating film caused by the acid component. This further suppresses occurrence of cracking in the insulating film 11.

The content of the inorganic fine particles is not particularly limited but preferably small from the viewpoint of dispersibility. Specifically, the insulating film 11 preferably includes 1 part by mass or more and 30 parts by mass or less of inorganic fine particles relative to 100 parts by mass of the resin component constituting the insulating film 11. The content of inorganic fine particles is preferably controlled so that the content of alkali metal ions or alkaline-earth metal ions falls within the above-described range.

The average particle size of the inorganic fine particles is not particularly limited but preferably 10 nm or more and 50 nm or less.

The thickness of the insulating film 11 is not particularly limited and is appropriately set to an optimal value depending on the application. The thickness of the insulating film 11 is preferably 5 μm or more in order to suppress the degradation of the insulating film 11 caused by the acid component. When the insulating film 11 including the predetermined inorganic fine particles is formed alone on the periphery of the conductor 10 as shown in FIG. 1, the thickness of the insulating film 11 is preferably 10 μm or more and 100 μm or less in order to maintain the predetermined insulating property.

(2) Coil and Motor

The motor according to an embodiment of the present invention includes a coil formed by winding the insulated wire described above. The motor is housed in a container with ester-based synthetic oil and thus incorporated in a drive unit. In the motor according to this embodiment, the insulated wire constituting the coil has high resistance to an acid component produced from ester-based synthetic oil, which suppresses the degradation of the insulated wire caused by the acid component. Therefore, a reduction in the insulating property of the motor with the operating time is small, that is, the motor has a long operating life.

Effect According to the Embodiment

According to the above-described embodiment, one or a plurality of effects described below are produced.

In the insulated wire according to the embodiment, the insulating film is composed of at least one selected from polyamide imide, polyester imide, and polyimide and includes inorganic fine particles containing alkali metal ions or alkaline-earth metal ions. This suppresses the degradation of the insulating film caused by the acid component produced by hydrolysis of ester-based synthetic oil. In other words, a reduction in the insulating property of the insulating film is suppressed. The retention of dielectric breakdown voltage after the insulated wire is immersed in ester-based synthetic oil for 2,000 hours reaches 60% or more. Furthermore, occurrence of cracking in the insulating film is suppressed.

In the insulated wire according to the embodiment, the insulating film includes 0.003 parts by mass or more and 0.018 parts by mass or less of alkali metal ions or alkaline-earth metal ions relative to 100 parts by mass of the resin component. This imparts a high insulating property to the insulating film and further suppresses the degradation of the insulating film caused by the acid component.

In the insulated wire according to the embodiment, the insulating film includes 1 part by mass or more and 30 parts by mass or less of inorganic fine particles relative to 100 parts by mass of the resin component. This imparts high dispersibility of the inorganic fine particles in the insulating film and further suppresses the degradation of the insulating film caused by the acid component.

The motor according to the embodiment includes a coil composed of the above-described insulated wire and has high resistance to ester-based synthetic oil. Therefore, a reduction in the insulating property of the motor with the operating time is small, that is, the motor has a short operating life.

Other Embodiments of the Present Invention

An embodiment of the present invention is specifically described above. However, the present invention is not limited to the above-described embodiment and various changes and modifications can be made without departing from the spirit and scope of the present invention.

Figure 2:
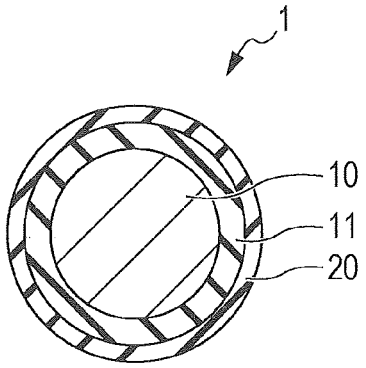
FIG. 2 is a cross-sectional view of an insulated wire according to another embodiment of the present invention.

In the above-described embodiment, an insulated wire in which an insulating film including a predetermined inorganic fine particles is formed directly on the periphery of a conductor is described. However, the present invention is not limited to this. In the present invention, two or more insulating films may be stacked on top of one another. For example, a first insulating film 11 that is an insulating film including predetermined inorganic fine particles and a second insulating film 20 that is a general-purpose insulating film may be stacked on the periphery of the conductor 10 in this order as shown in FIG. 2. The resin constituting the second insulating film 20 may be a general-purpose resin such as polyamide imide, polyester imide, or polyimide.

Figure 3:
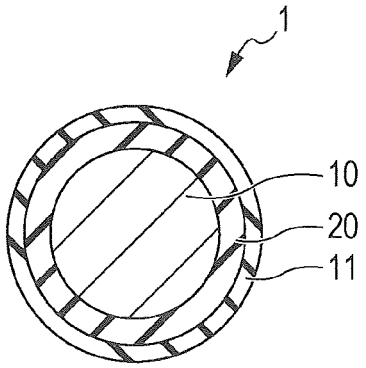
FIG. 3 is a cross-sectional view of an insulated wire according to another embodiment of the present invention.
Figure 4:
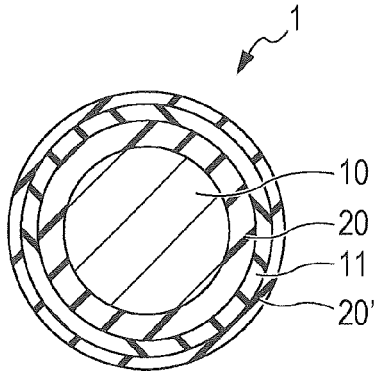
FIG. 4 is a cross-sectional view of an insulated wire according to another embodiment of the present invention.

As shown in FIG. 3, the second insulating film 20 may be interposed between the conductor 10 and the first insulating film 11. As shown in FIG. 4, a third insulating film 20' that is a general-purpose insulating film may be further stacked on the layered structure shown in FIG. 3. In FIGS. 3 and 4, the first insulating film 11 including the predetermined inorganic fine particles is not located at the surface of the insulated wire 1. However, an effect similar to that of the above-described embodiment can be produced. Specifically, the alkali metal ions or alkaline-earth metal ions contained in the inorganic fine particles diffuse from the first insulating film 11 to the second insulating film 20 or the third insulating film 20' and thereby capture and inactivate the acid component.

Figure 5:
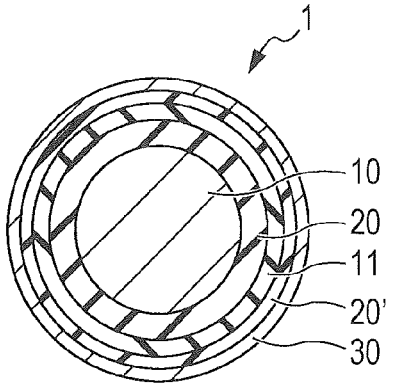
FIG. 5 is a cross-sectional view of an insulated wire according to another embodiment of the present invention.

As shown in FIG. 5, a self-lubricating film 30 containing a lubricant may be further formed in the layered structure shown in FIG. 4. The self-lubricating film 30 imparts lubricity to the surface of the insulated wire 1 and thereby reduces the processing stress caused when the insulated wire 1 is wound to form a coil. The self-lubricating film 30 is composed of, for example, a lubricating paint containing a lubricant and an enamel paint such as polyimide, polyester imide, or polyamide imide. The type of lubricant is not particularly limited and examples thereof include a polyolefin wax, fatty acid amide, and fatty acid ester.

Figure 6:
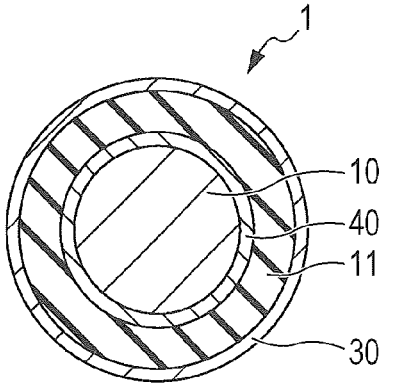
FIG. 6 is a cross-sectional view of an insulated wire according to another embodiment of the present invention.

As shown in FIG. 6, the first insulating film 11 and the self-lubricating film 30 may be stacked in this order on the periphery of the conductor 10 with an adhesion layer 40 interposed between the conductor 10 and the first insulating film 11. The adhesion layer 40 increases the adherence between the conductor 10 and the first insulating film 11.

EXAMPLES

Examples of the present invention are described below. In Examples, insulated wires each including an insulating film including predetermined inorganic fine particles were prepared. The insulated wires were immersed in ester-based synthetic oil and then evaluated on the degradation of the insulating film with immersion time.

(1) Preparation of Insulated Wire

In Example 1, an insulating paint A was prepared by dispersing 5 parts by mass of an organo-silica sol that was an organosol including inorganic fine particles in a paint for polyamide imide enamelled wire (paint for AIW) that was a plastic paint. The content of alkali metal ions (Na ions) was 0.003 parts by mass relative to 100 parts by mass of the resin component of the plastic paint. The insulating paint A was applied to the periphery of a copper wire serving as a conductor using a coating apparatus, and the resulting conductor was baked in a baking furnace. Thus, a first insulating film having a thickness of 25 μm was formed. The paint for AIW that was a plastic paint was applied to the periphery of the first insulating film and then baked to form a second insulating film having a thickness of 5 μm. Thus, an insulated wire (enamelled wire) of Example 1 including an insulating film having a two-layer structure (film thickness: 30 μm) was prepared. The paint for polyamide imide enamelled wire (paint for AIW) used was "HI-406" produced by Hitachi Chemical Company, Ltd. The organo-silica sol used was prepared by dispersing silica having an average particle size of 232 nm in a cyclohexanone disperse medium. The conductor used was a copper wire having an outside diameter of 0.8 mm.

In Example 2, an insulating paint B was prepared as in Example 1 except that the amount of organo-silica sol added was changed to 30 parts by mass so that the content of Na ions was 0.018 parts by mass relative to 100 parts by mass of the resin component of the plastic paint. A first insulating film (thickness 25 μm) composed of the insulating paint B was formed on the periphery of a copper wire, and a second insulating film (thickness 5 μm) composed of a paint for AIW was formed on the first insulating film. Thus, an insulated wire of Example 2 was prepared.

In Example 3, an insulating paint C was prepared as in Example 2 except that calcium carbonate ($CaCO_3$) was used as inorganic fine particles and 30 parts by mass of $CaCO_3$ was added in the plastic paint so that the content of Ca ions was 0.018 parts by mass. A first insulating film (thickness 25 μm) composed of the insulating paint C was formed on the periphery of a copper wire, and a second insulating film (thickness 5 μm) composed of a paint for AIW was formed on the first insulating film. Thus, an insulated wire of Example 3 was prepared.

In Example 4, an insulating paint D was prepared as in Example 1 except that the amount of organo-silica sol added was changed to 50 parts by mass so that the content of Na ions was 0.030 parts by mass relative to 100 parts by mass of the resin component of the plastic paint. A first insulating film (thickness 25 μm) composed of the insulating paint D was formed on the periphery of a copper wire, and a second insulating film (thickness 5 μm) composed of a paint for AIW was formed on the first insulating film. Thus, an insulated wire of Example 4 was prepared.

In Comparative Example 1, an insulating film was formed without using the predetermined inorganic fine particles, and an insulated wire was formed using the insulated film. Specifically, a paint for AIW was applied on the periphery of a copper wire and the resulting copper wire was baked. Thus, an insulated wire of Comparative Example 1 including an insulating film having a thickness of 30 μm was formed.

(2) Evaluation Method

The insulated wires prepared in Examples 1 to 4 and Comparative Example 1 were immersed in ester-based synthetic oil produced from acrylic acid (acid component) and ethylene glycol (alcohol component). Then, the degradation of the insulating films with immersion time was evaluated. Specifically, each of the insulated wires was wound for 10 turns around a winding rod having a diameter of three times the outside diameter of the conductor to prepare a sample. The sample was immersed in ester-based synthetic oil sealed in a container and heated to 155° C. After being immersed in the ester-based synthetic oil for a predetermined time, the container was cooled to a normal temperature (23° C.) and the sample was removed from the container. In Examples, immersion time was set to 0, 336, 504, 1008, 1512, and 2016 hours. For each immersion time, three samples were taken. These samples were evaluated by the following method.

The sample immersed in the ester-based synthetic oil for a predetermined time was subjected to a dielectric breakdown voltage test to observe the degradation of the insulating film. Specifically, the dielectric breakdown voltage of the insulated wire at each immersion time was measured. Then, the percentage of the dielectric breakdown voltage of the insulated wire at each immersion time based on 100% of the dielectric breakdown voltage of the insulated wire before immersion (0 hour), that is, the retention (%) of the dielectric breakdown voltage was determined. In Examples, the retention (%) of the dielectric breakdown voltage was calculated by taking the average of the three samples at each immersion time.

(3) Evaluation Results

Table 1 shows the evaluation results.

TABLE 1

| | Amount of added inorganic fine particles (Na ion content) | Measurement conditions Immersion time (hour) | Evaluation results Dielectric breakdown voltage (BDV: kV) | Dielectric breakdown voltage retention (%) |
|---|---|---|---|---|
| Example 1 | Silica: 5 parts by mass (Na ions: 0.003 parts by mass) | 0 | 8.7 | 100.0% |
| | | 336 | 7.1 | 80.9% |
| | | 504 | 6.9 | 78.6% |
| | | 1008 | 7.0 | 80.2% |
| | | 1512 | 6.1 | 70.0% |
| | | 2016 | 6.2 | 71.1% |
| Example 2 | Silica: 30 parts by mass (Na ions: 0.018 parts by mass) | 0 | 8.6 | 100.0% |
| | | 336 | 7.1 | 82.6% |
| | | 504 | 6.5 | 75.9% |
| | | 1008 | 7.0 | 81.0% |
| | | 1512 | 6.9 | 80.2% |
| | | 2016 | 6.6 | 77.1% |
| Example 3 | Calcium carbonate: 30 parts by mass (Ca ions: 0.018 parts by mass) | 0 | 9.3 | 100.0% |
| | | 336 | 8.0 | 86.1% |
| | | 504 | 7.4 | 79.6% |
| | | 1008 | 7.2 | 77.1% |
| | | 1512 | 6.8 | 72.9% |
| | | 2016 | 6.1 | 65.7% |

TABLE 1-continued

| | Amount of added inorganic fine particles (Na ion content) | Measurement conditions Immersion time (hour) | Evaluation results Dielectric breakdown voltage (BDV: kV) | Dielectric breakdown voltage retention (%) |
|---|---|---|---|---|
| Example 4 | Silica: 50 parts by mass (Na ions: 0.030 parts by mass) | 0 | 8.0 | 100.0% |
| | | 336 | 6.7 | 84.5% |
| | | 504 | 6.0 | 75.7% |
| | | 1008 | 4.8 | 60.3% |
| | | 1512 | 3.6 | 44.8% |
| | | 2016 | 2.7 | 34.3% |
| Comparative Example 1 | 0 part by mass (Na ions: 0 part by mass) | 0 | 9.1 | 100.0% |
| | | 336 | 7.7 | 84.6% |
| | | 504 | 0.3 | 2.9% |
| | | 1008 | 0.2 | 1.8% |
| | | 1512 | 0.2 | 1.8% |
| | | 2016 | 0.1 | 1.5% |

Figure 7:
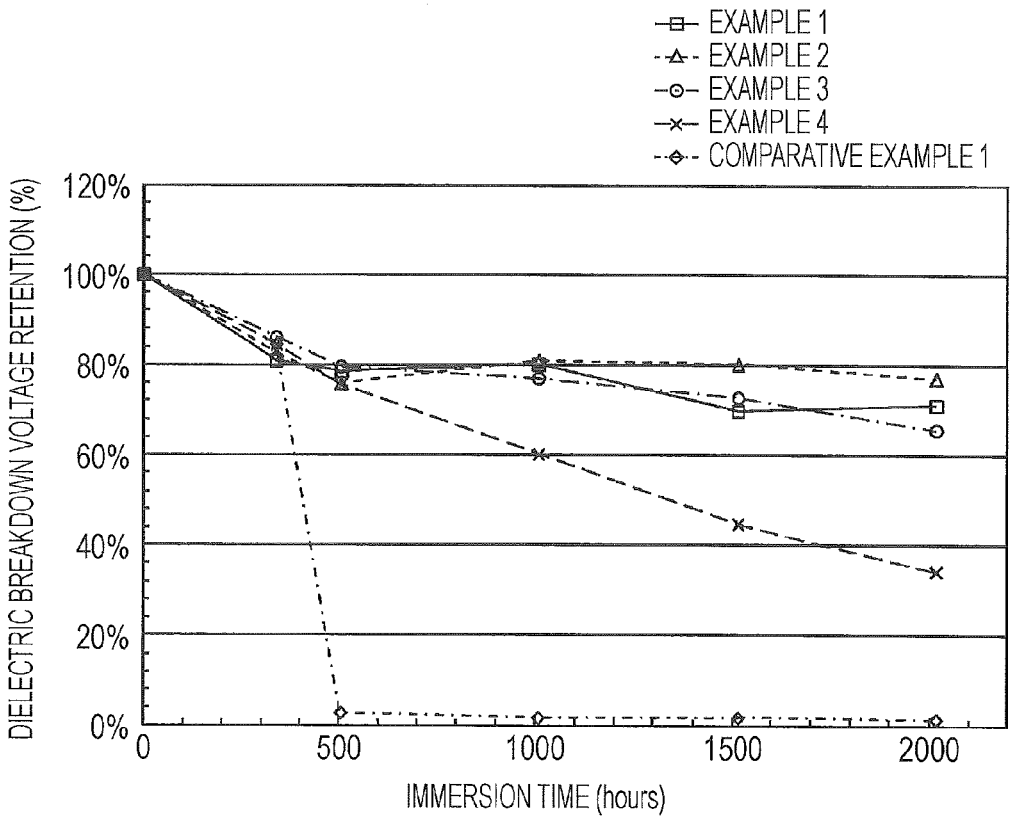
FIG. 7 is a diagram showing the correlation between immersion time and retention of dielectric breakdown voltage.

As shown in Table 1, in Examples 1 to 4, the retention of the dielectric breakdown voltage was 600 or more even after 1,000 hour immersion. FIG. 7 shows changes in the retention of the dielectric breakdown voltage with immersion time observed in Examples. FIG. 7 shows the correlation between the immersion time and the retention of the dielectric breakdown voltage. In FIG. 7, the abscissa shows immersion time (hour) and the ordinate shows retention (%) of the dielectric breakdown voltage. In FIG. 7, the rectangular symbols correspond to Example 1, the triangular symbols correspond to Example 2, the circular symbols correspond to Example 3, the cross-shaped symbols correspond to Example 4, and the diamond-shaped symbols correspond to Comparative Example 1. According to FIG. 7, in Examples 1 to 4, the dielectric breakdown voltage was reduced with immersion time but the reduction was suppressed. In other words, the degradation of the insulating film caused by an acid component produced from ester-based synthetic oil was suppressed. This is presumably because Na ions contained in organo-silica sol or Ca ions contained in calcium carbonate captured the acid component.

In particular, in Examples 1 and 2, the acid component was suitably captured since the content of Na ions was set to 0.003 to 0.018 parts by mass. As a result, the degradation of the insulating film was further suppressed and, the retention of the dielectric breakdown voltage after 2,000 hour immersion was 70% or more.

On the other hand, in Comparative Example 1, as shown in FIG. 7, the dielectric breakdown voltage was reduced with immersion time. The dielectric breakdown voltage was reduced significantly after 504 hour immersion. After 2,000 hour immersion, the retention of the dielectric breakdown voltage was 2% to 3%. This is presumably because an acid component produced from ester-based synthetic oil promoted the degradation of the insulating film since the insulating film did not include organo-silica sol containing Na ions.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

What is claimed is:

1. An insulated wire used under a condition where the insulated wire is brought into contact with ester-based synthetic oil, the insulated wire comprising:

a conductor; and an insulating film on a periphery of the conductor, the insulating film being composed of an insulating paint including:

at least one resin component selected from polyamide imide, polyester imide, and polyimide; and inorganic fine particles including alkali metal ion or alkaline-earth metal ion, wherein the insulating film includes 0.003 parts by mass or more and 0.018 parts by mass or less of the alkali metal ion or alkaline-earth metal ion relative to 100 parts by mass of the at least one resin component.

2. The insulated wire according to claim 1, wherein the insulating film includes 1 part by mass or more and 30 parts by mass or less of the inorganic fine particles relative to 100 parts by mass of the at least one resin component.

3. The insulated wire according to claim 1, wherein a retention of a dielectric breakdown voltage of the insulated wire is 60% or more after the insulated wire is immersed in the ester-based synthetic oil for 2,000 hours.

4. A coil formed by winding the insulated wire according to claim 1.

5. A motor including the coil according to claim 4.

6. The insulated wire according to claim 1, wherein the insulating film includes 0.003 parts by mass or more and 0.018 parts by mass or less of the alkali metal ion or alkaline-earth metal ion relative to 100 parts by mass of the at least one resin component to suppress a degradation of the insulating film caused by an acid component of the ester-based synthetic oil.

7. The insulated wire according to claim 1, wherein an average particle size of the inorganic fine particles is 10 nm or more and 50 nm or less.

8. The insulated wire according to claim 1, wherein a thickness of the insulating film is 5 μm or more.

9. The insulated wire according to claim 1, wherein a thickness of the insulating film is 5 μm or more in order to suppress a degradation of the insulating film caused by an acid component of the ester-based synthetic oil.

10. The insulated wire according to claim 1, wherein a thickness of the insulating film is 10 μm or more and 100 μm or less.

11. The insulated wire according to claim 1, further comprising a second insulating film stacked on the insulating film.

12. The insulated wire according to claim 1, further comprising a second insulating film, the second insulating film being devoid of the inorganic fine particles.

13. The insulated wire according to claim 1, further comprising a second insulating film disposed between the periphery of the conductor and the insulating film.

14. The insulated wire according to claim 1, further comprising:

a second insulating film disposed between the periphery of the conductor and the insulating film; and a third insulating film disposed on an outer surface of the insulating film.

15. The insulated wire according to claim 1, further comprising:

a second insulating film; and a third insulating film, wherein the insulating film is disposed between the second insulating film and the third insulating film.

16. The insulated wire according to claim 15, wherein the second insulating film and the third insulating film are devoid of the inorganic fine particles.

17. The insulated wire according to claim 15, further comprising a self-lubricating film including a lubricant disposed on an outer surface of the third insulating film.

18. The insulated wire according to claim 17, further comprising an adhesion layer disposed between the second insulating film and the periphery of the conductor.

19. The insulated wire according to claim 15, further comprising an adhesion layer disposed between the second insulating film and the periphery of the conductor.

20. The insulated wire according to claim 1, further comprising an adhesion layer disposed between the insulating film and the periphery of the conductor.

* * * * *